US008558416B2

(12) United States Patent
Johansen

(10) Patent No.: US 8,558,416 B2
(45) Date of Patent: Oct. 15, 2013

(54) POWER TRANSMISSION SYSTEM

(75) Inventor: Bjornar S. Johansen, Moss (NO)

(73) Assignee: Magtech AS, Moss (NO)

( * ) Notice: Subject to any disclaimer, the term of this patent is extended or adjusted under 35 U.S.C. 154(b) by 530 days.

(21) Appl. No.: 12/937,341

(22) PCT Filed: Apr. 2, 2009

(86) PCT No.: PCT/NO2009/000127

§ 371 (c)(1),
(2), (4) Date: Nov. 10, 2010

(87) PCT Pub. No.: WO2009/126046

PCT Pub. Date: Oct. 15, 2009

(65) Prior Publication Data

US 2011/0050004 A1 Mar. 3, 2011

Related U.S. Application Data

(60) Provisional application No. 61/044,202, filed on Apr. 11, 2008.

(51) Int. Cl.
*H01F 27/42* (2006.01)

(52) U.S. Cl.
USPC ..... 307/412

(58) Field of Classification Search
USPC ..... 307/412
See application file for complete search history.

(56) References Cited

U.S. PATENT DOCUMENTS

| | | | | |
|---|---|---|---|---|
| 6,933,822 | B2 * | 8/2005 | Haugs et al. | 336/100 |
| 7,180,206 | B2 * | 2/2007 | Haugs et al. | 307/102 |
| 7,256,678 | B2 * | 8/2007 | Haugs et al. | 336/212 |
| 2003/0076202 | A1 * | 4/2003 | Haugs et al. | 335/1 |
| 2005/0190585 | A1 * | 9/2005 | Haugs et al. | 363/54 |

FOREIGN PATENT DOCUMENTS

| | | | |
|---|---|---|---|
| GB | 2 361 107 | A | 10/2001 |
| WO | 99/28934 | A2 | 6/1999 |
| WO | 01/90835 | A1 | 11/2001 |
| WO | 03/044613 | A1 | 5/2003 |
| WO | 2004/053615 | A1 | 6/2004 |

OTHER PUBLICATIONS

International Search Report issued in PCT/NO2009/000127, mailed Aug. 12, 2009, 5 pages.
Written Opinion issued in PCT/NO2009/000127, mailed Aug. 12, 2009, 5 pages.
International Preliminary Report on Patentability issued in PCT/NO2009/000127, mailed Jul. 7, 2010, 9 pages.

* cited by examiner

*Primary Examiner* — Adi Amrany
(74) *Attorney, Agent, or Firm* — Osha Liang LLP

(57) ABSTRACT

The invention relates to a power transmission system for transmitting electrical power from a power source to a load. The system comprises a capacitive and lossy transmission line or cable and a transformer device. The transformer device comprises a magnetic core and a first winding wound around a first axis of the magnetic core. The first end of the transmission line or cable is connected to the power source and the second end of the transmission line is connected to the transformer device. A second winding wound around the first axis of the magnetic core, where the second winding is connected to the load. A control winding is wound around a second axis of the magnetic core, where the first axis and the second axis are orthogonal axes to that when the first winding, the second winding and/or the control winding are energized, orthogonal fluxes are generated in the magnetic core. A control system is connected to the control winding for controlling the permeability of the magnet core to automatically provide voltage control of the voltage supplied to the load and control of reactive power supplied to the cable.

2 Claims, 4 Drawing Sheets

Fig. 1: Prior art

POWER TRANSMISSION SYSTEM

FIELD OF THE INVENTION

The present invention relates to a power transmission system for transmitting electrical power from a power source to a load.

TECHNICAL BACKGROUND

There are some technical disadvantages related to different means for transferring electrical power, such as power transmission lines and power transmission cables, especially lossy and capacitive power transmission lines or cables.

Undersized power transmission lines for electric power are often referred to as "weak" lines. Such lines have a too small conductor cross section in relation to the load requirement, and consequently a relatively high resistance and hence high series impedance. Long transmission lines may also be capacitive.

Power transmission cables for transferring AC current may only be used up to a certain distance at high voltage levels, since their capacitive properties will prevent power transfer when the cables reaches a certain length. Long cables are also lossy, i.e. they have high series impedance.

Normally, a capacitive line or cable must be compensated to avoid/reduce the Ferranti effect. Moreover, a lossy line or cable may provide an excessive voltage drop resulting in inadequate voltage levels for the load connected to the line or cable.

Subsea power transmission cables are typically capacitive and lossy. Due to these properties, the length of such cables is limited. A step-up transformer may be provided in the end of the cable for transforming the voltage up to an acceptable level for the load during nominal load. However, if the load fails or is significantly reduced, the Ferranti effect will cause the cable end voltage to increase, possibly over allowed limits for the cable, penetrators or transformer. Hence, the load voltage will reach an unacceptable high level which may damage the load.

If the load is a subsea pump, the load may vary between zero and to a nominal load. Moreover, if a variable frequency converter is used to control the speed of the pump, the reactive power drawn from the cable will vary according to frequency.

In FIG. 1, corresponding to FIG. 43 of WO 03/044613, it is shown a magnetic device comprising a magnetic core, a first winding and a second winding wound around the core, and a control winding wound around the core for controlling the permeability of the core. The device may be used as a transformer with controllable magnetizing inductance.

The object of the present invention is to provide a power transmission system where the length of the capacitive and lossy power transmission cable can be increased.

Moreover, it is an object of the invention to provide a power transmission system which may handle load variations between zero and nominal load.

Moreover, it is an object of the invention to provide a power transmission system which may handle frequency variations of the input power between zero and a nominal frequency. In such situations, it should be possible to connect the power transmission system to a standard (i.e. off the shelf) frequency converter, that is, the power transmission system should not be dependent on the frequency converter or vice versa.

It is also an object to avoid power electronic components, i.e. semiconductor devices, in the main current line of the power transmission system.

Moreover, it is an object to provide a power transmission system with a control system which is independent of a separate power source.

SUMMARY OF THE INVENTION

The invention relates to a power transmission system for transmitting electrical power from a power source to a load, comprising:

- a capacitive and lossy transmission line or cable having a first end connected to the power source;
- a transformer device comprising:
- a magnetic core,
- a first winding wound around a first axis of the magnetic core, where the first winding is connected to a second end of the transmission line;
- a second winding wound around the first axis of the magnetic core, where the second winding is connected to the load; and
- a control winding wound around a second axis of the magnetic core, where the first axis and the second axis are orthogonal axes to that when the first winding, the second winding and/or the control winding are energized, orthogonal fluxes are generated in the magnetic core;
- a control system connected to the control winding for controlling the permeability of the magnet core to automatically provide voltage control of the voltage supplied to the load by controlling the reactive power drawn from the cable.

In an aspect of the invention, the system comprises a third winding wound around the first axis of the magnetic core, where the third winding is connected to the control system for supplying power to the control system.

In an aspect of the invention, the control system comprises a voltage sensor for measuring the output voltage, where a control current supplied to the control winding is based on comparing the measured output voltage with a reference output voltage.

In an aspect of the invention, the control system further comprises a frequency sensor for measuring the frequency of the voltage.

In an aspect of the invention, the control system comprises a predetermined voltage/frequency profile for controlling the output voltage based on the output voltage measurement and the frequency measurement.

In an aspect of the invention, the cable is a subsea cable.

In an aspect of the invention, the load is a subsea pumping station or a subsea power distribution system.

DETAILED DESCRIPTION

Embodiments of the invention will now be described with reference to the enclosed drawings, where:

Figure 2:
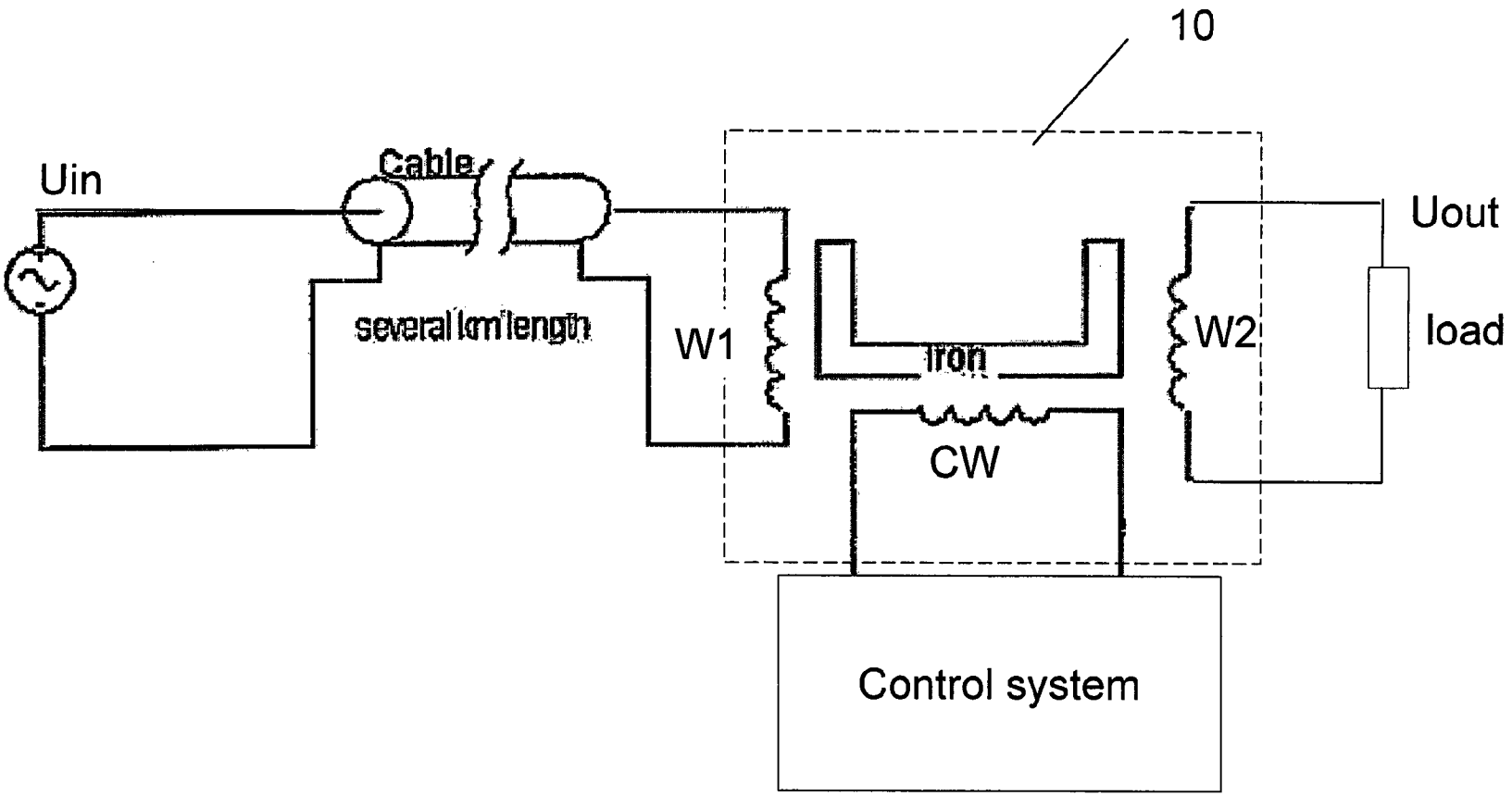
FIG. 2 illustrates a first embodiment.

It is now referred to FIG. 2. Here it is shown a power transmission system for transmitting electrical power from a power source, here referred to as Uin, to a load. The power source may be an AC power with a fixed frequency, or a frequency converter where the frequency may be variable between zero and a nominal frequency.

The voltage over the load is referred to as Uout. The load may for example be a frequency controlled pump. The load may vary between zero and a nominal value. It should be noted the load in such situations may vary considerably and rapidly, for example in case of gas pockets occurring in the fluid flow being pumped.

The power transmission system comprises a capacitive and lossy transmission cable. It should be noted that the transmission cable may also be a capacitive and lossy transmission line, i.e. in some situations, transmission lines exhibit the same properties as cables, and hence, the same or similar solutions as with respect to the cable may be applied to improve its properties.

As mentioned in the introduction, such cables may have a length of over tens to hundreds kilometers.

A first end of the transmission cable is connected to the power source Uin. A second end of the transmission cable is connected to a transformer device 10 with variable or controllable magnetizing inductance. The transformer device 10 is illustrated by a dashed box in FIG. 2.

In the embodiment shown in FIG. 2, the transformer device 10 comprises a magnetic core, a first winding W1, a second winding W2 and a control winding CW. The first winding W1 is wound around a first axis of the magnetic core and is connected to the second end of the transmission cable.

The second winding W2 is also wound around the first axis of the magnetic core. The second winding W2 is connected to the load.

The control winding CW is wound around a second axis of the magnetic core and is connected to a control system. The first axis and the second axis are orthogonal axes, so that when the first, second and/or control windings are energized, orthogonal fluxes are generated in the magnetic core.

The control system is arranged to control the permeability of the magnet core to automatically provide voltage control of the voltage supplied to the load by controlling the reactive power drawn from the cable. Hence, the control system comprises a voltage sensor for measuring the output voltage Uout.

The control system supplies a dc current $I_{control}$ to the control winding CW between a value of 0 to a nominal value, which will be on the system design. At a value of $I_{control}=0$, the transformer device opera as a "standard" transformer, where the output voltage Uout is dependent on the ration between the number of turns of the respective first and second windings W1 and W2. In such a situation, the transformer device does not draw more reactive power than an ordinary transformer.

At a value of $I_{control}>0$ and up to nominal value, the transformer device 10 consumes or draws reactive power, i.e. it compensates for the reactive power produced by the cable. Hence, the Ferranti effect is avoided or reduced. The Ferranti effect of the capacitive line/cable will tend to increase voltage during loads that are lower than nominal, here the transformer device 10 will consume the amount reactive power needed at all loads to still keep the load voltage at its nominal level.

Figure 1:
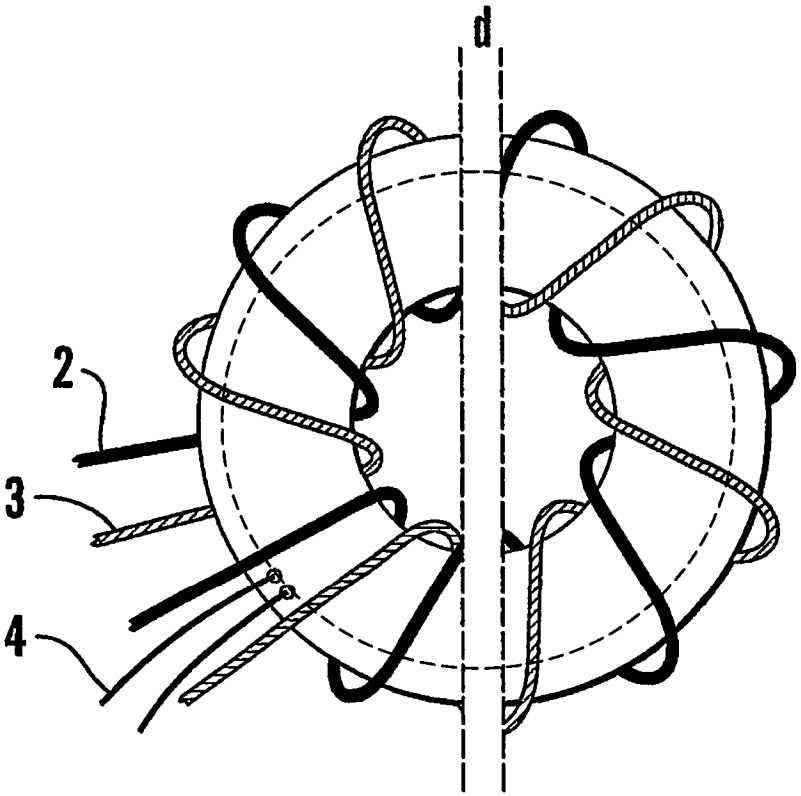
FIG. 1 illustrates a prior art transformer with controllable magnetizing inductance.

The transformer device 10 of FIG. 2 may correspond to the transformer with controllable magnetizing inductance illustrated in FIG. 1, where the first winding W1 corresponds to reference number 2, the second winding W3 corresponds to reference number 3 and the control winding corresponds to reference number 4.

In the embodiment shown in FIG. 2, the control system is supplied with power from a separate power supply, for example a DC or AC cable (not shown) from a nearby power source, in the cable itself, etc. In case the power supply is an AC power, the control system should comprise an AC/DC converter.

The control system controls the control current based on comparing a reference output voltage and a measured output voltage Uout. If the measured output voltage Uout is lower than the reference voltage, the control current is decreased to increase the output voltage again. If the measured output voltage is higher than the reference voltage, the control current is increased to decrease the output voltage again.

In addition, the frequency of the voltage of the end of the cable may be measured by means of a frequency sensor and given as an input signal to the control system. This would be the case if the power source is a frequency converter. If the frequency is at a nominal frequency, the control system should control the output voltage to be equal to nominal output voltage (i.e. $I_{control}$=zero). If, for instance, the frequency is 10% of nominal frequency, the control system should control the output voltage to be for example an output voltage equal to zero (i.e. $I_{control}$=nominal value). However, this will depend on the function of the frequency converter.

It will be possible to use both the measured frequency and the measured output voltage as input signals to the control system. In case the power source is a frequency converter the load voltage can then, by knowledge of the voltage and the frequency, be controlled (by means of the control current) to keep the V/f (voltage/frequency) ratio constant to give an induction motor its nominal air gap flux. Or, if needed, another predetermined V/f profile may be used, for example with voltage boost at low frequencies (i.e. a nonlinear V/f ratio).

According to the embodiment shown in FIG. 2, it is achieved that the power transmission length may be increased with a factor of 2-2.5, when compared with prior art technology, such as uncompensated cables.

Figure 4:
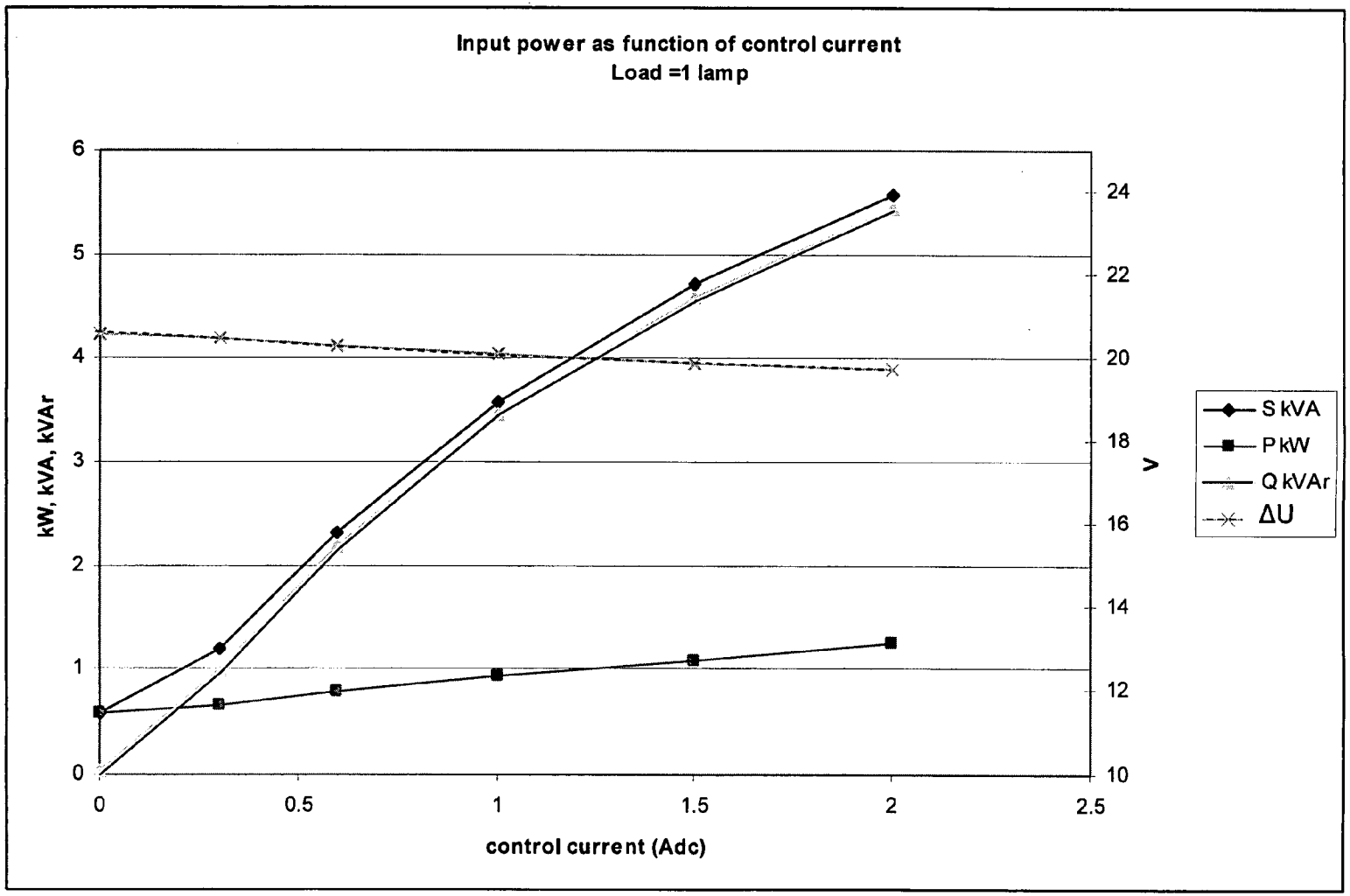
FIG. 4 illustrates a plot of the input power as a function of control current.

It is now referred to FIG. 4, illustrating different variables depending on the control current. Here, it can be seen that while the output voltage indicated by ΔU is relatively constant, the reactive power Q may be controlled by means of the control current.

Figure 3:
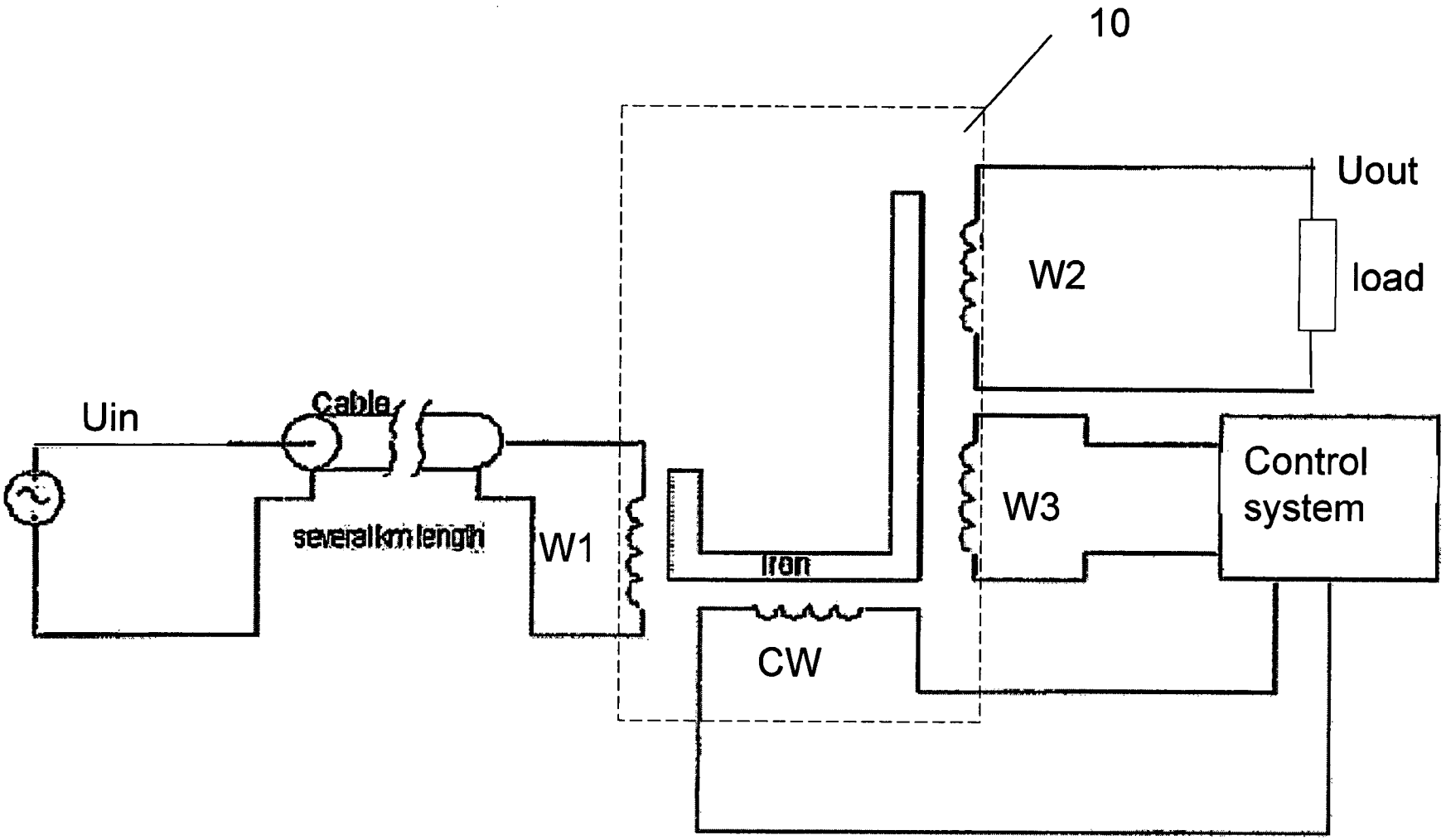
FIG. 3 illustrates a second embodiment.

A second embodiment of the invention is illustrated in FIG. 3. The system comprises the same elements as described in relation to FIG. 2 above, and the same reference numbers/letters are used. Hence, these same elements are not described in detail here.

In the embodiment in FIG. 3 a third winding MW3 is wound around the first axis of the magnetic core. The third winding MW3 is connected to the control system for supplying power to the control system. Consequently, when the first winding W1 is magnetized by means of the cable, a voltage is generated over the third winding W3, and hence the control system is supplied with power. Moreover, when the power to the cable is shut off, there is no voltage over the first winding W1 and hence no voltage over the third winding w3 either.

According to the embodiment of FIG. 3, no separate power source is needed for the control system. It should be noted that by wounding the third winding around the core, electric insulation between the control system and the power transmission system is provided.

The invention claimed is:

1. Power transmission system for transmitting electrical power from a power source to a subsea load, comprising:

a capacitive and lossy subsea cable having a first end connected to the power source;

a transformer device comprising:

a magnetic core, a first winding wound around a first axis of the magnetic core, where the first winding is connected to a second end of the subsea cable;

a second winding wound around the first axis of the magnetic core, where the second winding is connected to the subsea load; and a control winding wound around a second axis of the magnetic core, where the first axis and the second axis are orthogonal axes to that when the first winding, the second winding and/or the control winding are energized, orthogonal fluxes are generated in the magnetic core;

a control system connected to the control winding for controlling the permeability of the magnet core to automatically provide voltage control of the voltage supplied to the subsea load by controlling the reactive power drawn from the subsea cable; where the control system comprises a voltage sensor for measuring the output voltage, where a control current supplied to the control winding is based on comparing the measured output voltage with a reference output voltage and where the control system supplies a dc current $I_{control}$ between a value of 0 to a nominal value to the control winding and when the value of $I_{control}>0$, the transformer device consumes or draws reactive power to compensate for the reactive power produced by the subsea cable; and where the control system further comprises a frequency sensor for measuring the frequency of the voltage and where the control system comprises a predetermined voltage/frequency profile for controlling the output voltage based on the output voltage measurement and the frequency measurement.

2. The power transmission system according to claim 1, where the power transmission system comprises a third winding wound around the first axis of the magnetic core, where the third winding is connected to the control system for supplying power to the control system.

* * * * *